United States Patent [19]

Derderian et al.

[11] Patent Number: 4,553,342

[45] Date of Patent: Nov. 19, 1985

[54] ARTICLE OF FOOTWEAR WITH AN ADJUSTABLE WIDTH, ADJUSTABLE TENSION CLOSURE SYSTEM

[75] Inventors: Thomas Derderian, Exeter; Daniel J. Richard, Portsmouth, both of N.H.

[73] Assignee: Nike, Inc., Beaverton, Oreg.

[21] Appl. No.: 483,254

[22] Filed: Apr. 8, 1983

[51] Int. Cl.[4] ..... A43B 5/00; A43C 5/00

[52] U.S. Cl. ..... 36/97; 36/50; 24/140; 24/141

[58] Field of Search ..... 36/97, 50; 24/68 SK, 24/71 SK, 140, 141, 142, 117, 119

[56] References Cited

U.S. PATENT DOCUMENTS

| | | | |
|---|---|---|---|
| 595,833 | 12/1897 | McElroy | 24/140 |
| 872,037 | 11/1907 | White | 24/140 |
| 1,043,003 | 10/1912 | Faegre | 24/140 |
| 1,296,529 | 3/1919 | Koester | 36/50 |
| 1,434,723 | 11/1922 | Triay | 126/58 |
| 1,466,075 | 8/1923 | Triay | 24/140 |
| 2,239,324 | 4/1941 | Hills | 24/141 |
| 2,239,325 | 4/1941 | Hills | 24/141 |
| 3,169,325 | 2/1965 | Fesl | 36/2.5 |
| 3,333,304 | 8/1967 | Daddona | 24/145 |
| 4,255,876 | 3/1981 | Johnson | 36/50 |
| 4,373,275 | 2/1983 | Lydiard | 36/129 |
| 4,413,431 | 11/1983 | Cavanagh | 36/50 |

FOREIGN PATENT DOCUMENTS

| | | | |
|---|---|---|---|
| 1386684 | 5/1965 | France . | |
| 2481583 | 11/1981 | France | 24/141 |
| 12944 | of 1902 | United Kingdom | 24/140 |

OTHER PUBLICATIONS

"Tech Tags" bulletin by Nike, Inc. entitled Variable Width Lacing System.

*Primary Examiner*—Werner H. Schroeder
*Assistant Examiner*—Steven N. Meyers
*Attorney, Agent, or Firm*—Banner, Birch, McKie & Beckett

[57] ABSTRACT

An athletic shoe with an adjustable width, adjustable tension "speedlace" closure system is disclosed. The system comprises a serpentine closure element body with relatively wide shoelace openings at different widths across the throat of the shoe, shoelace holes which frictionally grip a shoelace threaded therethrough, and a guide ridge on the shoelace openings.

17 Claims, 7 Drawing Figures

ARTICLE OF FOOTWEAR WITH AN ADJUSTABLE WIDTH, ADJUSTABLE TENSION CLOSURE SYSTEM

TECHNICAL FIELD

This invention relates to an adjustable width, adjustable tension shoe lace closure system for an article of footwear. The closure system is particularly adapted for use on an athletic shoe used for running or jogging.

BACKGROUND OF THE INVENTION

The modern athletic shoe is a combination of many elements which have specific functions, all of which must work together for the support and protection of the foot during an athletic event. The design of an athletic shoe has become a highly refined science. No longer do athletes and participants in sports events use a pair of "sneakers" for all sports. Athletic shoes today are as varied in design and purpose as are the rules for the sports in which the shoes are worn. Tennis shoes, racquetball shoes, basketball shoes, running shoes, baseball shoes, football shoes, weightlifting shoes, etc., are all designed to be used in very specific, and very different, ways. They are also designed to provide a unique and specific combination of traction, support, and protection to enhance athletic performance. Not only are shoes designed for specific sports, they are also designed to meet the specific characteristics of the user. For example, athletic shoes are designed differently for heavier persons than for lighter persons; differently for wide feet than for narrow feet; differently for high arches than for low arches, etc. Some shoes are designed to correct physical problems, such as over-pronation, while others include devices, such as ankle supports, to prevent physical problems from developing.

An athletic shoe is divided into two general parts, an upper and a sole. The upper is designed to snugly and comfortably enclose the foot. In a running or jogging shoe, the upper typically will have several layers, including a weather and wear resistent outer layer of leather or synthetic material, such as nylon, and a soft padded inner liner for foot comfort. Current uppers typically have an intermediate layer of a synthetic foam material. The three layers of the upper may be fastened together by stitching, gluing or a combination of these. In areas of maximum wear or stress, reinforcements of leather and/or plastic are attached to the upper. Two examples of such reinforcements are leather toe sections attached over synthetic inner layers of the toe area, and heel counters made of an inner layer of plastic in an outer layer of leather.

The other major portion of the athletic shoe is the sole. The sole must provide traction, protection, and a durable wear surface. The considerable forces generated by running require that the sole of a running shoe provide enhanced protection and shock absorption for the foot and leg. Accordingly, the sole of a running shoe typically includes several layers, including a resilient, energy absorbent material as a midsole and a ground contacting outer sole or outsole, which provides both durability and traction. This is particularly true for training or jogging shoes designed to be used over long distances and over a long period of time. The sole also provides a broad, stable base to support the foot during ground contact.

The closure system of an athletic shoe is important to its comfort and fit. In principle, all closure systems serve to secure the shoe upper against the foot. Traditionally, closure systems for athletic and other shoes have included shoelaces which are threaded through eyelets around a throat or tongue opening in the upper portion of the shoe. The placement of the eyelet rows, particularly their distance from a point where the sole and upper meet, influences the effect the laces will have in cinching the upper against the foot. The closure system must be able to adapt to feet of various widths and to varying personal preferences about snugness of fit.

It has also been found advantageous to employ "speedlaces" in athletic shoes. "Speedlaces" employ wide shoelace openings which are larger than the uncompressed cross-section of the shoelace to permit a single pull on the end of the shoelace to easily pull the shoelace through all the openings and tighten the shoelace throughout its lacing pattern with uniform tension. One type of currently available "speedlaces" is formed of a plastic bar from which a plurality of aligned large eyelets extend.

Some users may find a more comfortable shoe fit with different lacing tension over different parts of the foot. For example, the top of the foot, that is the portion over the instep, is sensitive because nerves are nearer to the surface. If the shoe is too tight in this area, the nerve can be aggrevated. However, in other areas, particularly in the toe area and around the ankle area, it may be more comfortable to have tighter tension on the shoelaces. Prior art "speedlace" designs do not allow for adjustable tension; that is, "speedlaces" do not allow the shoelace to apply different tension at different areas along the foot. They permit only a single uniform tension over the entire length of the lacing system.

An adjustable width lacing system offers greater control over the fit of the shoe through the use of staggered eyelets which vary the width across the throat at which the shoelaces apply pressure. Such a lacing system is disclosed in U.S. Pat. No. 4,255,876 to Jeffrey O. Johnson issued on Mar. 17, 1981. Numerous variations can be utilized to create a custom fit: eyelet rows that are placed far apart are often used by runners with narrow feet for a snug fit. Eyelet rows that are placed closely together are recommended for runners with wide feet. Athletes with feet of average width often prefer to lace through all the eyelet pairs. Currently available variable width lacing systems are simply formed as staggered eyelets or openings in the reinforcement strip about the throat of the shoe. Such openings engage the shoelaces with a slight amount of friction, thus preventing the shoelace from being uniformly applying pressure to the foot by pulling on the end of the shoelace.

Lacing closure systems have been disclosed which use lace locking devices, such as restricted diameter eyelets in U.S. Pat. No. 1,434,723 issued to Triay on Nov. 7, 1922. The locking device maintains the preset tension on laces at a paticularly location along the lacing system.

SUMMARY OF THE INVENTION

This invention relates to an article of footwear which utilizes an improved adjustable width lacing system. The footwear includes an upper which surrounds the foot of a wearer and sole attached to the upper for contacting the ground. The upper includes a throat with lateral and medial edges. A plurality of pairs of first shoelace encircling members are disposed along the lateral and medial edges of the throat, and a shoe lace having an uncompressed first cross-section is adapted to be laced through at least some of the first shoelace circling members. The first shoelace encircling members have a cross-section larger than the first cross-section to permit the shoelace to pass freely therethrough so that by pulling on the ends of the shoelace, the shoelace can be moved through substantially all of the first encircling members to apply a uniform pressure to the foot. The pairs of first shoelace encircling members are located at various widths across the throat.

The present invention is also directed to an adjustable width closure element per se which is formed of an elongated plastic bar from which the first encircling members extend at staggered locations about the longitudinal direction of the bar.

In a preferred embodiment, the article of footwear also includes a reinforcing member attached to the material of the upper along the lateral and medial edges of the throat. At least one pair of second shoelace encircling members is disposed along the lateral and medial edges of the throat and is located between an uppermost and a lowermost pair of the first encircling members. The at least one pair of second encircling members has a cross-section sufficiently less than the first cross-section to frictionally engage the shoelace so that the tension of the shoelace laced through the first encircling members, which are located below the at least one pair of second encircling members, can be set by passing the shoelace through the at least one pair of second shoelace encircling members.

The closure element itself comprises a serpentine body having an outer portion, which is attached to the upper along the edge of the throat and an inner portion. The outer portion is stitched to the upper and is not visible when attached to the upper. The inner portion is the part which is visible, faces inward toward the throat and through which shoelaces are threaded. The first shoelace encircling members are formed as shoelace openings in the inner portion which are sized so as to permit a shoelace to pass freely through the openings so that the article of footwear may be laced closed by pulling on the ends of the shoelace threaded through the openings. This form of shoelace opening is conventionally called a speedlace system because it allows the user to rapidly lace close the article of footwear by merely pulling on the exposed ends of the shoelace. The shoelace openings in the inner portion are shaped to follow the contours of the serpentine body of the closure element. Accordingly, the shoelace openings are each somewhat curved in shape. In general, the width of the openings is less than the length of the openings.

The closure element is formed in the preferred embodiment with a notch in the inner portion. The notch in effect is merely an area of the closure element in which there is no inner portion and no shoelace opening. The notch is adapted to be positioned over the metatarsal area of the article of footwear in order to provide enhanced flexibility of the closure element over the metatarsal area.

The second shoelace encircling member is formed as plurality of shoelace holes in the reinforcing member. The reinforcing member includes an insert which is fastened between the upper material and an outer layer of the reinforcing member. In the preferred embodiment, the insert is formed of a hard rubber material. The holes in the insert and the holes in the reinforcing member are sized so that they will firmly and frictionally grip a shoelace threaded through the holes. This permits the shoelace tension between adjacent holes to be set and maintained.

An athletic shoe in accordance with the present invention has the advantage of adjustable width lacing, i.e., the capability of customizing the application of lacing pressure to the various instep configurations of users, while at the same time taking advantage of a "speedlacing" system. However, the disadvantage of a typical speedlacing system, i.e., the inability to vary the tension at selected portions of the lacing system is overcome by providing a second set of lacing openings at one or more locations along the length of the throat which permits the user to selectively set the tension of the first larger shoelace openings below a pair of the second smaller openings merely by lacing the shoelace through the second smaller openings.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

DESCRIPTION OF THE PREFERRED EMBODIMENT

Figure 1:
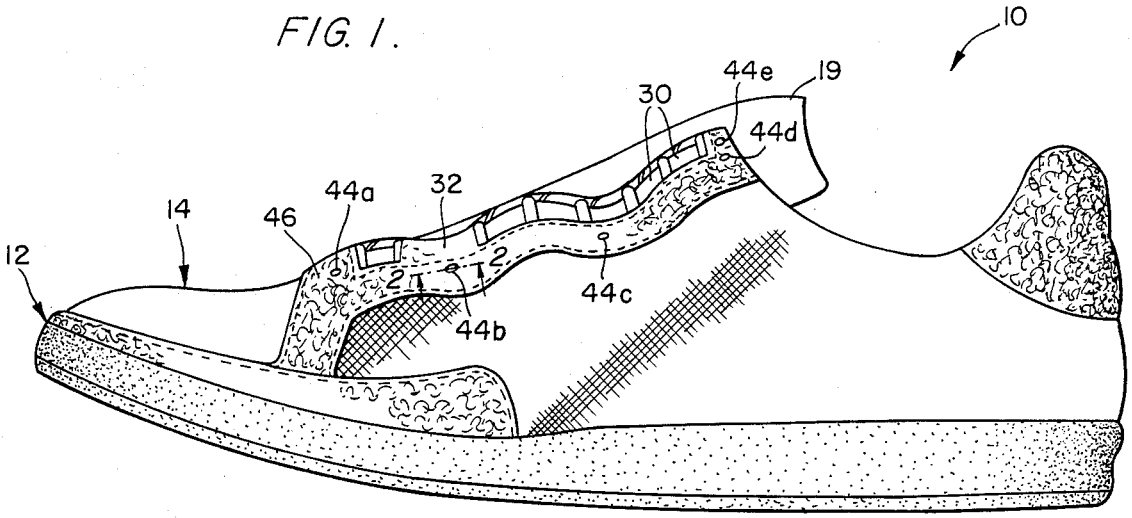
FIG. 1 is a side view of an athletic shoe embodying the invention.
Figure 2:
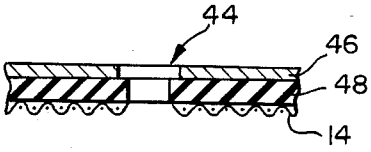
FIG. 2 is a sectional view taken generally along line 2—2 of FIG. 1.

An article of footwear in accordance with the present invention, such as a running shoe, is generally shown as 10. Running shoe 10 includes a sole 12 and an upper 14 attached to it. Upper 14 includes a throat 16 which has opposing facing sides 17 and 18. A tongue 19 extends below throat 16. The upper is intended to be closed by a shoelace 20 threaded through the closure system.

Figure 3:
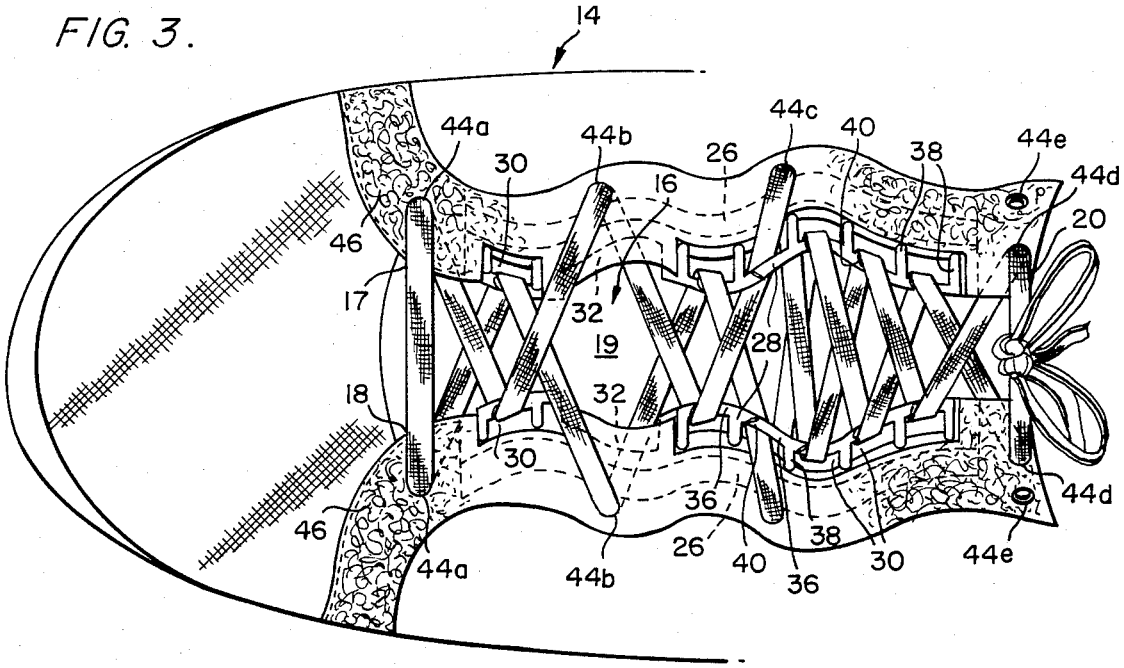
FIG. 3 is a top view of a portion of an athletic shoe embodying the invention.
Figure 4:
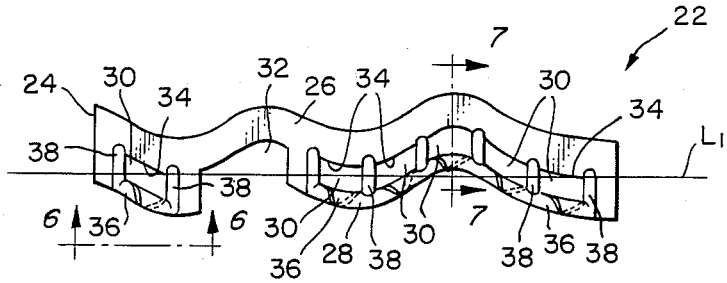
FIG. 4 is a top view of an adjustable width closure element according to the invention.

The adjustable width, adjustable tension closure system of the present invention includes an adjustable width closure element 22 shown in FIG. 4. Closure element 22 includes an elongate body 24, preferably serpeninte in configuration, having an outer portion 26 fastened to upper 14 along one of the opposing facing sides 17, 18 of throat 16, and an inner portion 28 facing inward toward throat 16. A second closure element 22 is fastened to the upper on the other side of throat 16. Inner portion 28 has a plurality of first shoelace encircling members or openings 30 for selectively receiving a shoelace. Shoelace openings 30 are staggered about the longitudinal direction ($L_1$) of body 24 to offer greater control over the fit of the shoe. With both closure elements 22 attached to upper 14, the staggered openings 30 guide lace 20 through aligned pairs of openings at different distances or effective widths across throat 16. Numerous variations of lace threading patterns can be utilized to create a custom fit. Openings 30 that are placed far apart can be used by runners with narrow feet for a snug fit. Openings 30 that are placed closely together are recommended with wide feet. Runners with feet of average width can lace through all of the shoelace openings 30 as shown in FIG. 3.

The adjustable width closure element incorporates a feature for the shoelace openings which is referred to generally as "speedlaces," that is, the shoelace openings 30 are sized larger than the uncompressed cross-section of the shoelace so as to permit a shoelace to pass freely through the openings. The running shoe may thus be laced closed with a uniform tension by pulling on the ends of a shoelace threaded through the openings. This "speedlace" type closure allows the wearer to quickly lace closed the running shoe. However, it results in uniform tension throughout the lacing of the shoelace closure system. As will be explained below, another element of the present invention permits the tension to adjusted and set at selected locations along throat 16.

Shoelace openings 30 are shaped to follow the contours of the serpentine body. Also, the width of the shoelace openings is less than the length of the shoelace openings 30, thus defining a somewhat rectangular opening through which the shoelace 20 may pass freely.

The serpentine body 24 of closure element 22 includes a notch or space 32. At notch 32 there is no shoelace opening 30 or no inner portion 28 of the closure element 22. Notch 32 is adapted to be positioned over the metatarsal area of the running shoe in order to provide enhanced flexibility of the closure element 22 over the metatarsal area, as shown in FIGS. 1 and 3. Body 24 is preferably made of a plastic material, such as nylon. Body 24 must be sufficiently strong to retain the shape of openings 30 under the stress of tightened shoelaces, yet be sufficiently flexible for comfort. To attain such strength and flexibility, plastic body 24 is generally formed as a flat, thin, for example 1 to 2.5 mm thick, body.

As shown more particularly in FIG. 4, each of the shoelace openings 30 includes an outer wall 34, an inner wall 36, and two transverse walls 38 interconnecting outer wall 34 to inner wall 36. A spiral edge 40, preferably raised, is formed on the inner wall 36 of each of the shoelace openings 30 in order to properly guide shoelace 20 through the shoelace openings in a generally upward, slanted direction along throat 16 and to keep shoelace 20 flat on top of inner wall 36. Spiral edge 40 directs the shoelace towards the top portion of the closure system in order to facilitate proper and speedy closure.

Figure 5:
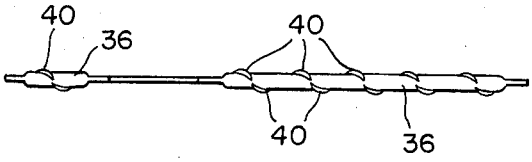
FIG. 5 is a front view of the adjustable width closure element illustrated in FIG. 4.
Figure 6:
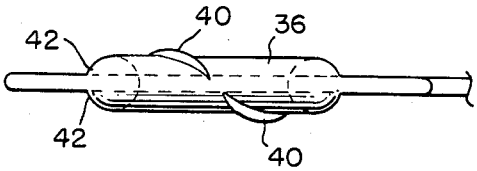
FIG. 6 is a view of the adjustable width closure element illustrated in FIG. 4 taken generally along line 6—6.
Figure 7:
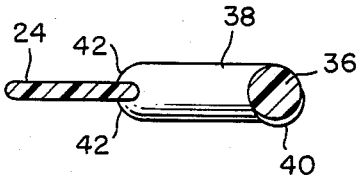
FIG. 7 is a sectional view of the adjustable width closure element illustrated in FIG. 4 taken generally along line 7—7.

Serpentine body 24 of adjustable width closure element 22 has a substantially flat overall configuration as shown at FIGS. 4 and 5. Transverse walls 38 and inner wall 36 have a substantially circular cross-section thus defining a raised lip 42 on three sides of opening 30, and outer portion 24 has a substantially flat cross-section as best illustrated in FIGS. 6 and 7.

The present invention also provides means for selectively setting and maintaining the tension of the shoelace along selected portions of the shoelace closure. A plurality of second shoelace encircling members or holes 44 are positioned around the throat or tongue opening 16 and beyond the periphery of the outer portion 26 of the serpentine body 24 of closure element 22. Holes 44 are arranged as aligned pairs **44*a*–44*e* on opposite sides of throat 16, at locations spaced along the length of throat 16. The shoelace holes 44 are sized to firmly and frictionally grip a shoelace threaded through the shoelace holes 44. Thus, if a certain tension is desired below a position along the length of throat 16, shoelace 20 is laced through the pair of holes 44 at the position, and the desired tension is set. The frictional engagement of the shoelace with the relatively small holes 44 will maintain the tension of the shoelace laced through openings 30 below holes 44. Tension applied by shoelace 20 can be set at different levels at different locations along throat 16 by lacing shoelace 20 through more than one pair of holes 44. For example, shoelace 20 can be laced through the two lowermost pair of holes 44*a* and 44*b*, with the tension below hole 44*a* set at one level and the tension between holes 44*a* and 44*b* set at another level. Once the tension between adjacent pairs of shoelace holes 44** is set, normal pressures such as lacing or running will not loosen the preset tension. The tension may, of course, be adjusted manually and reset. Thus, once the user has found a tension over a particular portion of the foot which is most comfortable, that tension can be set and maintained while the shoe is opened and closed without sacrificing the ability to recreate that exact tension the next time the shoe is worn.

The shoelace holes 44 are preferably formed in a reinforcing member 46 surrounding throat 16. Reinforcing member 46 is typically made of leather and is sewn to the material of upper 14. An insert 48 may be attached between reinforcing member 46 and the material of upper 14. Holes 44 are formed through upper 14, insert 48 and reinforcing member 46. While a plurality of pairs **44*a*–44*e* of holes 44 are illustrated, one pair of holes 44 would suffice if it were desired to set the tension of the shoelace only below one specific point along throat 16. In the preferred embodiment, insert 48** would be made of a hard rubber or rubber-like material which would be both flexible and provide frictional engagement of the shoelace.

Although the invention has been described with reference to a particular embodiment, it is to be understood that the invention is limited only by the following claims.

We claim:

1. A closure element, for attachment along the tongue opening of an article of footwear to receive and guide shoelaces of a lacing system, comprising:

a plurality of shoelace encircling members adapted to be attached along the edges of the tongue opening, said shoelace encircling members being sized larger than the cross-section of the shoelace to permit the shoelace to pass freely therethrough; and a spiral edge formed on an outer surface of each of said shoelace encircling members for guiding a shoelace threaded through said shoelace encircling member in a generally upwardly inclined direction of the tongue.

2. A closure element as recited in claim 1 wherein said shoelace encircling members are formed as portions of an integral body.

3. A closure element as recited in claim 2 wherein said body is elongate and said shoelace encircling members are formed along one longitudinal side thereof at locations, staggered with respect to the longitudinal direction of said body.

4. A closure element as recited in claim 3 wherein said shoelace encircling members include a serpentine edge of said body on which said spiral edge is formed.

5. An article of footwear comprising:

an upper for surrounding the foot of a wearer and a sole attached to said upper for contacting the ground, said upper including a throat with lateral and medial edges, a reinforcing member attached to the material of said upper along the lateral and medial edges of said throat, a plurality of pairs of first shoelace encircling members disposed along the lateral and medial edges of said throat, at least one pair of second shoelace encircling members disposed along the lateral and medial edges of said throat and a shoelace having an uncompressed first cross-section, said first shoelace encircling members having a cross-section larger than said first cross-section to permit said shoelace to pass freely therethrough so that by pulling on the ends of said shoelace the shoelace can be moved through substantially all of said first encircling members, and said at least one pair of second encircling members being located between an uppermost and a lowermost pair of said first encircling members and having a cross-section sufficiently less than said first cross-section to frictionally engaging said shoelace so that the tension of the shoelace laced through said first encircling members located below said at least one pair of second encircling members can be set by passing said shoe shoelace through said at least one pair of second shoelace encircling members.

6. An article of footwear recited in claim 5 wherein said reinforcing member includes an insert fastened between the material of the upper and an outer layer of reinforcing material, said insert being formed of a rubber or rubber-like material, said pairs of said second shoelace encircling members being formed as holes in said reinforcing member.

7. An article of footwear comprising:

an upper for surrounding the foot of a wearer and a sole attached to said upper for contacting the ground, said upper including a throat with lateral and medial edges, a reinforcing member attached to the material of said upper along the lateral and medial edges of said throat, an adjustable width closure element including an elongate body attached to said upper along each of said edges of said throat and a plurality of pairs of first shoelace encircling members extending from said bodies, said first shoelace encircling members being arranged at different widths across said throat, at least one pair of second shoelace encircling members formed in said reinforcing member along the lateral and medial edges of said throat, a shoelace having an uncompressed first cross-section, said first shoelace encircling members having a cross-section larger than said first cross-section to permit said shoelace to pass freely therethrough so that by pulling on the ends of said shoelace the shoelace can be moved through substantially all of said first encircling members, a spiral guide ridge being formed in said first shoelace encircling members for guiding said shoelace in a generally upward direction along said throat and said at least one pair of second encircling members being located between an uppermost and a lowermost pair of said first encircling members and having a cross-section sufficiently less than said first cross-section to frictionally engaging said shoelace so that the tension of the shoelace laced through said first encircling members located below said at least one pair of second encircling members can be set by passing said shoe shoelace through said at least one pair of second shoelace encircling members.

8. An article of footwear as recited in claim 7 wherein said body has a serpentine configuration with an outer portion attached to the upper and an inner portion.

9. An article of footwear as recited in claim 8 wherein said body has a substantially overall flat configuration, and said transverse walls and said inner wall of said first shoelace encircling members have a substantially circular cross-section, thus defining a raised lip on three sides of said first shoelace encircling members.

10. An article of footwear as recited in claim 8 wherein said first shoelace encircling members are shaped to follow the contours of said serpentine body.

11. An article of footwear as recited in claim 10 wherein the width of said first shoelace encircling members is less than the length of said first shoelace encircling members.

12. An article of footwear as recited in claim 7 wherein said body has a notch in along its inner side positioned over the metatarsal area of the article of footwear in order to provide enhanced flexibility of said body over the metatarsal area.

13. An article of footwear as recited in claim 7 wherein said reinforcing member includes an insert fastened between the material of the upper and an outer layer of reinforcing material, said insert being formed of a rubber or rubber-like material, and said second shoelace encircling members being formed as holes in said insert and reinforcing material.

14. An article of footwear as recited in claim 7 wherein each of said first shoelace encircling comprises an inner wall, an outer wall, and two transverse walls interconnecting said inner wall to said outer wall, and said guide ridge being formed on said inner wall.

15. An article of footwear as recited in claim 7 including a plurality of pairs of said second shoelace encircling members located at spaced locations along the length of said lateral and medial edges of said throat.

16. An adjustable width closure element, for attachment to an article of footwear closed by a lacing system, comprising:

a discrete elongate body formed of a plastic material, said body having an outer longitudinal portion adapted to be fastened to an article of footwear along the edge of the throat and an inner longitudinal portion;

a plurality of discrete shoelace openings formed in the inner portion of said body for selectively receiving a shoelace, said shoelace openings being located at longitudinally spaced locations along said inner portion of body and being staggered inward and outward with respect to the longitudinal dimension of said body;

each of said shoelace openings comprising an inner wall, an outer wall, and two transverse walls interconnecting said inner wall to said outer wall, and a raised spiral edge formed on said inner wall for guiding a shoelace threaded through said shoelace opening in a generally upwardly slanted direction along a throat of a shoe.

17. An article of footwear comprising:

an upper for surrounding the foot of a wearer and a sole attached to said upper for contacting the ground, said upper including a throat with lateral and medial edges, a reinforcing member attached to the material of said upper along the lateral and medial edges of said throat, a plurality of pairs of first shoelace encircling members disposed along the lateral and medial edges of said throat, said pairs of first shoelace encircling members being located at different widths across said throat, a shoelace having an uncompressed first cross-section, said first shoelace encircling members having a cross-section larger than said first cross-section to permit said shoelace to pass freely therethrough so that by pulling on the ends of said shoelace the shoelace can be moved through substantially all of said first encircling members, and at least one pair of second shoelace encircling members disposed along the lateral and medial edges of said throat, said at least one pair of second encircling members being located between an uppermost and a lowermost pair of said first encircling members and having a cross-section sufficiently less than said first cross-section to frictionally engage said shoelace so that the tension of the shoelace laced through said first encircling members located below said at least one pair of second encircling members can be set by passing said shoe shoelace through said at least one pair of second shoelace encircling members.

* * * * *